US011505842B2

(12) United States Patent
Okatsu et al.

(10) Patent No.: US 11,505,842 B2
(45) **Date of Patent: *Nov. 22, 2022**

(54) LOW-ALLOY HIGH-STRENGTH SEAMLESS STEEL PIPE FOR OIL COUNTRY TUBULAR GOODS

(71) Applicant: JFE Steel Corporation, Tokyo (JP)

(72) Inventors: Mitsuhiro Okatsu, Tokyo (JP); Masao Yuga, Tokyo (JP); Yoichi Ito, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/956,800

(22) PCT Filed: Dec. 6, 2018

(86) PCT No.: PCT/JP2018/044837

§ 371 (c)(1),
(2) Date: Jun. 22, 2020

(87) PCT Pub. No.: WO2019/131037

PCT Pub. Date: Jul. 4, 2019

(65) Prior Publication Data

US 2020/0325553 A1 Oct. 15, 2020

(30) Foreign Application Priority Data

Dec. 26, 2017 (JP) ..... JP2017-248911

(51) Int. Cl.
*B22D 11/00* (2006.01)
*C21D 8/10* (2006.01)
(Continued)

(52) U.S. Cl.
CPC ..... *C21D 8/105* (2013.01); *C21C 7/06* (2013.01); *C22C 38/001* (2013.01);
(Continued)

(58) Field of Classification Search
None
See application file for complete search history.

(56) References Cited

U.S. PATENT DOCUMENTS 4,178,979 A 12/1979 Birat et al.
6,267,828 B1 7/2001 Kushida et al.
(Continued)

FOREIGN PATENT DOCUMENTS

EP 3192890 7/2017
EP 3222740 9/2017
(Continued)

OTHER PUBLICATIONS

Extended European Search Report for European Application No. 18897677.3, dated Aug. 25, 2020, 7 pages.
(Continued)

*Primary Examiner* — Seth Dumbris
*Assistant Examiner* — Kim S. Horger
(74) *Attorney, Agent, or Firm* — RatnerPrestia

(57) ABSTRACT

Provided herein is a low-alloy high-strength seamless steel pipe. The steel pipe of the present invention has a composition that contains, in mass %, C: 0.20 to 0.50%, Si: 0.01 to 0.35%, Mn: 0.45 to 1.5%, P: 0.020% or less, S: 0.002% or less, 0: 0.003% or less, Al: 0.01 to 0.08%, Cu: 0.02 to 0.09%, Cr: 0.35 to 1.1%, Mo: 0.05 to 0.35%, B: 0.0010 to 0.0030%, Ca: 0.0010 to 0.0030%, Mg: 0.001% or less, and N: 0.005% or less, and in which the balance is Fe and incidental impurities. The steel pipe has a microstructure in which the number of oxide-base nonmetallic inclusions satisfying the composition ratios represented by predefined formulae is 20
(Continued)

or less per 100 $mm^2$, and in which the number of oxide-base nonmetallic inclusions satisfying the composition ratios represented by other predefined formulae is 50 or less per 100 $mm^2$.

4 Claims, 2 Drawing Sheets

(51) Int. Cl.

| | |
|---|---|
| ***C21C 7/06*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/32*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/32* (2013.01)

(56) References Cited

U.S. PATENT DOCUMENTS

| | | | | |
|---|---|---|---|---|
| 8,163,010 | B1 | 5/2012 | Omura et al. | |
| 9,175,371 | B2 | 11/2015 | Numata et al. | |
| 2006/0016520 | A1 | 1/2006 | Numata et al. | |
| 2012/0042992 | A1 | 2/2012 | Kondo et al. | |
| 2012/0186704 | A1 | 7/2012 | Eguchi et al. | |
| 2013/0034205 | A1 | 4/2013 | Numata et al. | |
| 2015/0041030 | A1 | 2/2015 | Kondo et al. | |
| 2017/0349963 | A1* | 12/2017 | Yuga | C21D 6/004 |
| 2018/0327881 | A1 | 11/2018 | Yuga et al. | |
| 2019/0228063 | A1 | 7/2019 | Arai et al. | |
| 2020/0040436 | A1 | 2/2020 | Arai et al. | |

FOREIGN PATENT DOCUMENTS

| | | | | |
|---|---|---|---|---|
| JP | 2000178682 | A | 6/2000 | |
| JP | 2000297344 | A | 10/2000 | |
| JP | 2001131698 | A | 5/2001 | |
| JP | 2002060893 | A | 2/2002 | |
| JP | 2005350754 | A | 12/2005 | |
| JP | 2011089180 | A | 5/2011 | |
| JP | 2016094649 | A | 5/2016 | |
| WO | 2010113953 | A1 | 10/2010 | |
| WO | 2011155140 | A1 | 12/2011 | |
| WO | 2013133076 | A1 | 9/2013 | |
| WO | 2016038809 | A1 | 3/2016 | |
| WO | 2016079908 | A1 | 5/2016 | |
| WO | WO-2016103537 | A1 * | 6/2016 | C22C 38/42 |
| WO | 2018043570 | A1 | 3/2018 | |
| WO | 2018066889 | A1 | 4/2018 | |

OTHER PUBLICATIONS

Non Final Office Action for U.S. Appl. No. 16/956,805, dated May 28, 2021, 18 pages.
International Search Report and Written Opinion for International Application No. PCT/JP2018/044835, dated Feb. 26, 2019, 5 pages.
International Search Report and Written Opinion for International Application No. PCT/JP2018/044837, dated Mar. 5, 2019, 4 pages.
International Search Report and Written Opinion for International Application No. PCT/JP2018/044836, dated Feb. 26, 2019, 5 pages.
Non Final Office Action for U.S. Appl. No. 16/956,805, dated Mar. 1, 2022, 19 pages.
Final Office Action for U.S. Appl. No. 16/956,805, dated Sep. 2, 2021, 8 pages.
Non Final Office Action for U.S. Appl. No. 16/064,086, dated Apr. 9, 2021, 16 pages.
Final Office Action for U.S. Appl. No. 16/064,086, dated Dec. 28, 2020, 15 pages.
Non Final Office Action for U.S. Appl. No. 16/064,086, dated Jun. 10, 2020, 28 pages.
Holappa, L., "Secondary Steelmaking," Treatise on Process Metallurgy, Elsevier, 2014, 301-345, Chapter 1.6.
Non Final Office Action for U.S. Appl. No. 16/957,738, dated Nov. 23, 2021, 34 pages.
Final Office Action for U.S. Appl. No. 16/957,738, dated Apr. 15, 2022, 13 pages.
Final Office Action for U.S. Appl. No. 16/956,805, dated Jun. 27, 2022, 17 pages.
Notice of Allowance for U.S. Appl. No. 16/957,738, dated Jun. 14, 2022, 8 pages.

* cited by examiner

[FIG. 1]
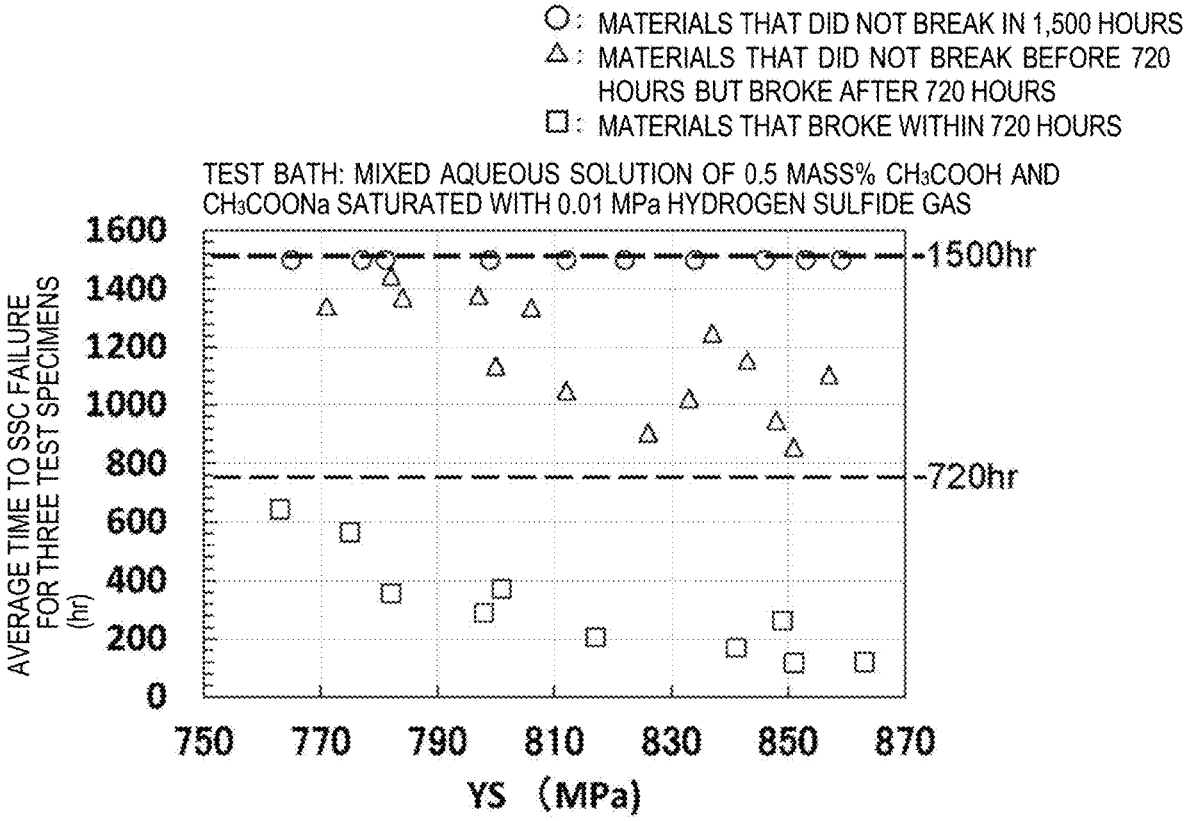
[FIG. 2]
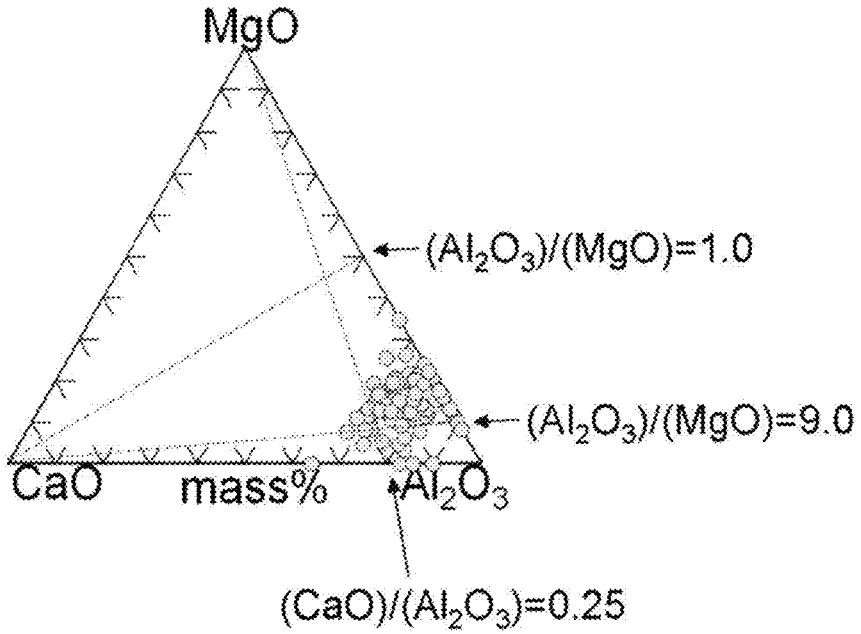

[FIG. 3]
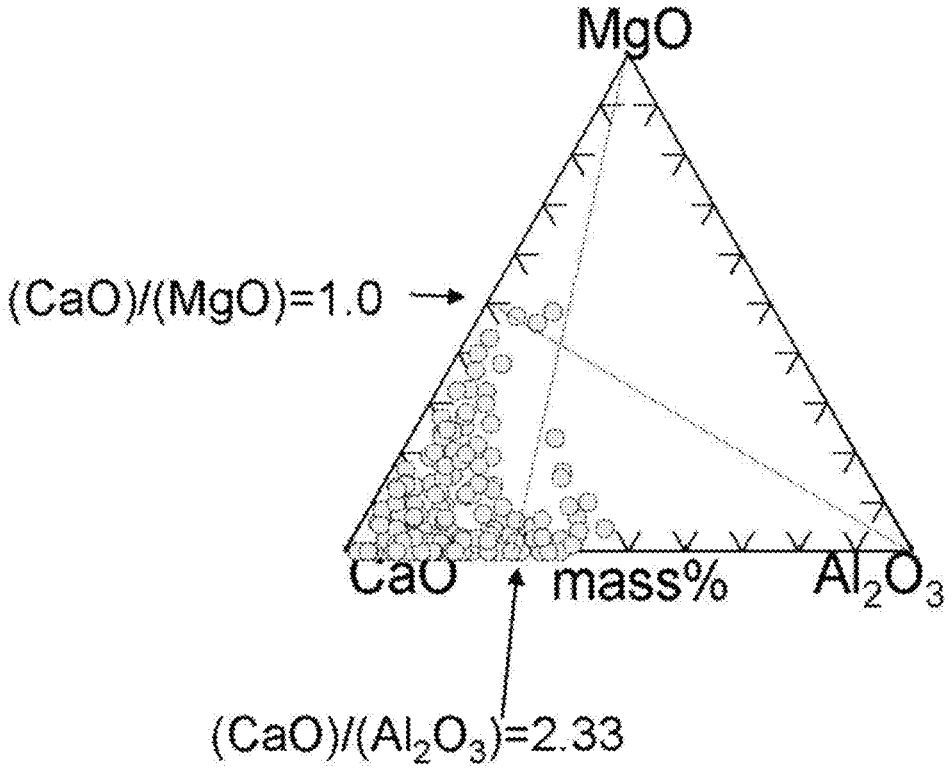
[FIG. 4]
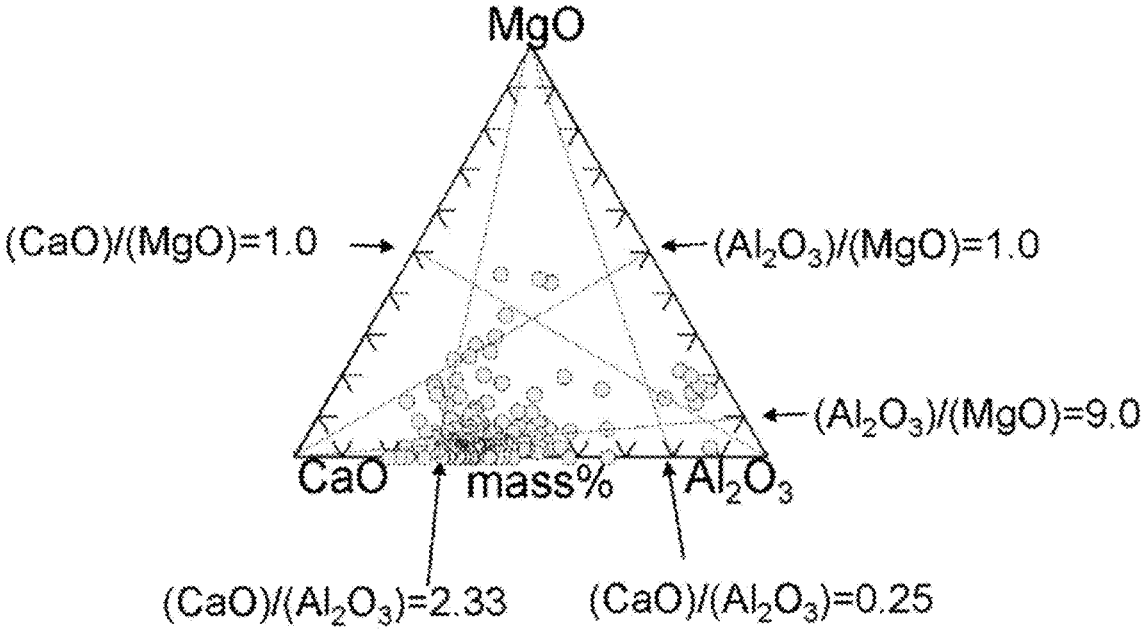

LOW-ALLOY HIGH-STRENGTH SEAMLESS STEEL PIPE FOR OIL COUNTRY TUBULAR GOODS

CROSS REFERENCE TO RELATED APPLICATIONS

This is the U. S. National Phase application of PCT/JP2018/044837, filed Dec. 6, 2018, which claims priority to Japanese Patent Application No. 2017-248911, filed Dec. 26, 2017, the disclosures of these applications being incorporated herein by reference in their entireties for all purposes.

FIELD OF THE INVENTION

The present invention relates to a high-strength seamless steel pipe for oil wells and gas wells (hereinafter, also referred to simply as "oil country tubular goods"), specifically, a low-alloy high-strength seamless steel pipe for oil country tubular goods having excellent sulfide stress corrosion cracking resistance (SSC) in a sour environment containing hydrogen sulfide. As used herein, "high strength" means strength with a yield strength of 758 to 861 MPa (110 ksi or more and less than 125 ksi).

BACKGROUND OF THE INVENTION

Increasing crude oil prices and an expected shortage of petroleum resources in the near future have prompted active development of oil country tubular goods for use in applications that were unthinkable in the past, for example, such as in deep oil fields, and in oil fields and gas oil fields of hydrogen sulfide-containing severe corrosive environments, or sour environments as they are also called. The material of steel pipes for oil country tubular goods intended for these environments requires high strength, and excellent corrosion resistance (sour resistance).

Out of such demands, for example, PTL 1 discloses a steel for oil country tubular goods having excellent sulfide stress corrosion cracking resistance. The steel is a low-alloy steel that contains, in weight %, C: 0.2 to 0.35%, Cr: 0.2 to 0.7%, Mo: 0.1 to 0.5%, and V: 0.1 to 0.3%, and in which the total amount of precipitated carbide is 2 to 5 weight %, of which the fraction of MC-type carbide is 8 to 40 weight %.

PTL 2 discloses a steel pipe having excellent sulfide stress corrosion cracking resistance. The steel pipe contains, in mass %, C: 0.22 to 0.35%, Si: 0.05 to 0.5%, Mn: 0.1 to 1%, P: 0.025% or less, S: 0.01% or less, Cr: 0.1 to 1.08%, Mo: 0.1 to 1%, Al: 0.005 to 0.1%, B: 0.0001 to 0.01%, N: 0.005% or less, O (oxygen): 0.01% or less, Ni: 0.1% or less, Ti: 0.001 to 0.03% and 0.00008/N % or less, V: 0 to 0.5%, Zr: 0 to 0.1%, and Ca: 0 to 0.01%, and the balance Fe and impurities. In the steel pipe, the number of TiN having a diameter of 5 μm or more is 10 or less per square millimeter of a cross section. The yield strength is 758 to 862 MPa, and the crack generating critical stress (σth) is 85% or more of the standard minimum strength (SMYS) of the steel material.

PTL 3 discloses a steel for oil country tubular goods having excellent sulfide stress corrosion cracking resistance. The steel contains, in mass %, C: 0.15 to 0.35%, Si: 0.1 to 1.5%, Mn: 0.15 to 2.5%, P: 0.025% or less, S: 0.004% or less, sol. Al: 0.001 to 0.1%, and Ca: 0.0005 to 0.005%, and the composition of Ca-base nonmetallic inclusions satisfies $100-X \leq 120-(10/3) \times HRC$, where X is the total amount of CaO and CaS (mass %).

PATENT LITERATURE

PTL 1: JP-A-2000-178682
PTL 2: JP-A-2001-131698
PTL 3: JP-A-2002-60893

SUMMARY OF THE INVENTION

The sulfide stress corrosion cracking resistance of the steels in the techniques disclosed in PTL 1 to PTL 3 is based on the presence or absence of SSC after a round tensile test specimen is placed under a load of a certain stress in a test bath saturated with hydrogen sulfide gas, according to NACE (National Association of Corrosion Engineering) TM0177, Method A.

In PTL 1, the test bath used for evaluation in an SSC test is a 25° C. aqueous solution containing 0.5% acetic acid and 5% salt saturated with 1 atm (=0.1 MPa) hydrogen sulfide. In PTL 2, the SSC test conducted for evaluation uses a 25° C. aqueous solution of 0.5% acetic acid and 5% salt as a test bath under a hydrogen sulfide partial pressure of 1 atm (=0.1 MPa) for C110. In PTL 3, the test bath used for evaluation in an SSC test is an aqueous solution of 0.5% acetic acid and 5% salt saturated with 1 atm (=0.1 MPa) hydrogen sulfide. The SSC test is conducted for 720 hours in all of PTL 1 to PTL 3.

However, the actual well environment is not always such a 1-atm hydrogen sulfide gas saturated environment. For example, there is an increasing demand for a steel pipe for oil country tubular goods that is simply required to withstand an SSC test under 0.1 atm (=0.01 MPa), because such steel pipes require smaller amounts of alloy elements, and can be produced at low cost while achieving a yield strength in the order of 110 ksi (758 to 861 MPa).

Under a low hydrogen sulfide gas partial pressure, hydrogen ions ($H^+$) present in a test solution enter a test piece at a slower rate per unit time in the form of atomic hydrogen. However, the hydrogen that entered a test piece under a low hydrogen sulfide gas partial pressure decays at a slower rate per unit time after being immersed for a long time in a test solution than when the partial pressure of hydrogen sulfide gas is high (for example, 1 atm (=0.1 MPa)). Recent studies revealed that SSC can occur when the hydrogen that entered the steel accumulates after being immersed for a long time in a test solution, and reaches a critical amount that causes cracking. That is, the traditional SSC evaluation test involving a dipping time of 720 hours is insufficient, particularly in an environment where the partial pressure of hydrogen sulfide gas is low, and SSC needs to be prevented also in an SSC test that involves a longer dipping time.

Aspects of the present invention have been made to provide a solution to the foregoing problems, and it is an object according to aspects of the present invention to provide a low-alloy high-strength seamless steel pipe for oil country tubular goods having high strength with a yield strength of 758 to 861 MPa, and excellent sulfide stress corrosion cracking resistance (SSC resistance) even after a long time in a relatively mild hydrogen sulfide gas saturated environment, specifically, a sour environment with a hydrogen sulfide gas partial pressure of 0.01 MPa or less.

In order to find a solution to the foregoing problems, the present inventors conducted an SSC test in which seamless steel pipes of various chemical compositions having a yield strength of 758 to 861 MPa were dipped for 1,500 hours according to NACE TM0177, method A. A 24° C. mixed aqueous solution of 0.5 mass % of $CH_3COOH$ and $CH_3COONa$ was used as a test bath after saturating the solution with 0.1 atm (=0.01 MPa) of hydrogen sulfide gas. The test bath was adjusted so that it had a pH of 3.5 after the solution was saturated with hydrogen sulfide gas. The stress applied in the SSC test was 90% of the actual yield strength of the steel pipe. Three test specimens were tested in the SSC test of each steel pipe sample. The average time to failure for the three test specimens in an SSC test is shown in the graph of FIG. 1, along with the yield strength of each steel pipe. In FIG. 1, the vertical axis represents the average of time to failure (hr) for the three test specimens tested in each SSC test, and the horizontal axis represents the yield strength YS (MPa) of steel pipe.

In FIG. 1, none of the three test specimens indicated by open circles broke in 1,500 hours in the SSC test. In contrast, all of the three test specimens, or one or two of the three test specimens indicated by open squares broke in the SSC test, and the average time to failure for the three test specimens was less than 720 hours (time to failure was calculated as 1,500 hours for pipes that did not break). None of the three test specimens indicated by open triangles broke in 720 hours in the SSC test. However, all of the three test specimens, or one or two test specimens eventually broke, with an average time to failure of more than 720 hours and less than 1,500 hours.

With regard to SSC that cannot be found with the dipping time of 720 hours used in the related art, the present inventors conducted intensive studies based on the results of the foregoing experiment. Specifically, the present inventors conducted an investigation as to why some test specimens break within 720 hours as in the related art while others remain unbroken even after 720 hours and up to 1,500 hours. The investigation found that these different behaviors of SSC vary with the distribution of inclusions in the steel. Specifically, for observation, a sample with a 13 mm×13 mm cross section across the longitudinal direction of the steel pipe was taken from a position in the wall thickness of the steel pipe from which an SSC test specimen had been taken for the test. After polishing the surface in mirror finish, the sample was observed for inclusions in a 10 mm×10 mm region using a scanning electron microscope (SEM), and the chemical composition of the inclusions was analyzed with a characteristic X-ray analyzer equipped in the SEM. The contents of the inclusions were calculated in mass %. It was found that most of the inclusions with a major diameter of 5 μm or more were oxides including $Al_2O_3$, CaO, and MgO, and a plot of the mass ratios of these inclusions on a ternary composition diagram of $Al_2O_3$, CaO, and MgO revealed that the oxide compositions were different for different behaviors of SSC.

FIG. 2 shows an example of a ternary composition diagram of the inclusions $Al_2O_3$, CaO, and MgO having a major diameter of 5 μm or more in a steel pipe that had an average time to failure of more than 720 hours and less than 1,500 hours in FIG. 1. As shown in FIG. 2, the steel pipe contained very large numbers of $Al_2O_3$—MgO composite inclusions having a relatively small CaO ratio. FIG. 3 shows an example of a ternary composition diagram of the inclusions $Al_2O_3$, CaO, and MgO having a major diameter of 5 μm or more in a steel pipe that had an average time to failure of 720 hours or less in FIG. 1. As shown in FIG. 3, the steel pipe, in contrast to FIG. 2, contained very large numbers of CaO—$Al_2O_3$—MgO composite inclusions having a large CaO ratio. FIG. 4 shows an example of a ternary composition diagram of the inclusions $Al_2O_3$, CaO, and MgO having a major diameter of 5 μm or more in a steel pipe that did not break all of the three test specimens in 1,500 hours in FIG. 1. As shown in FIG. 4, the number of inclusions having a small CaO ratio, and the number of inclusions having a large CaO ratio are smaller than in FIG. 2 and FIG. 3.

From these results, a composition range was derived for inclusions that were abundant in the steel pipe that had an average time to failure of more than 720 hours and less than 1,500 hours, and in which SSC occurred on a test specimen surface, and for inclusions that were abundant in the steel pipe that had an average time to failure of 720 hours or less, and in which SSC occurred from inside of the test specimen. These were compared with the number of inclusions in the composition observed for the steel pipe in which SSC did not occur in 1,500 hours, and the upper limit was determined for the number of inclusions of interest.

Aspects of the present invention were completed on the basis of these findings, and are as follows.

[1] A low-alloy high-strength seamless steel pipe for oil country tubular goods, the steel pipe having a yield strength of 758 to 861 MPa, and having a composition that contains, in mass %, C: 0.20 to 0.50%, Si: 0.01 to 0.35%, Mn: 0.45 to 1.5%, P: 0.020% or less, S: 0.002% or less, O: 0.003% or less, Al: 0.01 to 0.08%, Cu: 0.02 to 0.09%, Cr: 0.35 to 1.1%, Mo: 0.05 to 0.35%, B: 0.0010 to 0.0030%, Ca: 0.0010 to 0.0030%, Mg: 0.001% or less, and N: 0.005% or less, and in which the balance is Fe and incidental impurities, the steel pipe having a microstructure in which the number of oxide-base nonmetallic inclusions including CaO, $Al_2O_3$, and MgO and having a major diameter of 5 μm or more in the steel, and satisfying the composition ratios represented by the following formulae (1) and (2) is 20 or less per 100 $mm^2$, and in which the number of oxide-base nonmetallic inclusions including CaO, $Al_2O_3$, and MgO and having a major diameter of 5 μm or more in the steel, and satisfying the composition ratios represented by the following formulae (3) and (4) is 50 or less per 100 $mm^2$, $$(CaO)/(Al_2O_3) \leq 0.25 \quad (1)$$

$$1.0 \leq (Al_2O_3)/(MgO) \leq 9.0 \quad (2)$$

$$(CaO)/(Al_2O_3) \geq 2.33 \quad (3)$$

$$(CaO)/(MgO) \geq 1.0 \quad (4)$$

wherein (CaO), ($Al_2O_3$), and (MgO) represent the contents of CaO, $Al_2O_3$, and MgO, respectively, in the oxide-base nonmetallic inclusions in the steel, in mass %.

[2] The low-alloy high-strength seamless steel pipe for oil country tubular goods according to item [1], wherein the composition further contains, in mass %, one or more selected from Nb: 0.005 to 0.035%, V: 0.005 to 0.02%, W: 0.01 to 0.2%, and Ta: 0.01 to 0.3%.

[3] The low-alloy high-strength seamless steel pipe for oil country tubular goods according to item [1] or [2], wherein the composition further contains, in mass %, one or two selected from Ti: 0.003 to 0.10%, and Zr: 0.003 to 0.10%.

As used herein, "high strength" means having strength with a yield strength of 758 to 861 MPa (110 ksi or more and less than 125 ksi). The low-alloy high-strength seamless steel pipe for oil country tubular goods according to aspects of the present invention has excellent sulfide stress corrosion cracking resistance (SSC resistance). As used herein, "excellent sulfide stress corrosion cracking resistance" means that three steel pipes subjected to an SSC test conducted according to NACE TM0177, method A all have a time to failure of 1,500 hours or more (preferably, 3,000 hours or more) in a test bath, specifically, a 24° C. mixed aqueous solution of 0.5 mass % $CH_3COOH$ and $CH_3COONa$ saturated with 0.1 atm (=0.01 MPa) hydrogen sulfide gas.

As used herein, "oxides including CaO, $Al_2O_3$, and MgO" mean CaO, $Al_2O_3$, and MgO that remain in the solidified steel in the form of an aggregate or a composite formed at the time of casting such as continuous casting and ingot casting. Here, CaO is an oxide that generates by a reaction of the oxygen contained in a molten steel with calcium added for the purpose of, for example, controlling the shape of MnS in the steel. $Al_2O_3$ is an oxide that generates by a reaction of the oxygen contained in a molten steel with the deoxidizing material Al added when tapping the molten steel into a ladle after refinement by a method such as a converter process, or added after tapping the molten steel. MgO is an oxide that dissolves into a molten steel during a desulfurization treatment of the molten steel as a result of a reaction between a refractory having the MgO—C composition of a ladle, and a CaO—$Al_2O_3$—$SiO_2$-base slug used for desulfurization.

Aspects of the present invention can provide a low-alloy high-strength seamless steel pipe for oil country tubular goods having high strength with a yield strength of 758 to 861 MPa, and excellent sulfide stress corrosion cracking resistance (SSC resistance) even after a long time in a relatively mild hydrogen sulfide gas saturated environment, specifically, a sour environment with a hydrogen sulfide gas partial pressure of 0.01 MPa or less.

BRIEF DESCRIPTION OF THE DRAWINGS

FIG. 1 is a graph representing the yield strength of steel pipe, and an average time to failure for three test specimens in an SSC test.

FIG. 2 is an example of a ternary composition diagram of inclusions $Al_2O_3$, CaO, and MgO having a major diameter of 5 μm or more in a steel pipe having an average time to failure of more than 720 hours and less than 1,500 hours in an SSC test.

FIG. 3 is an example of a ternary composition diagram of inclusions $Al_2O_3$, CaO, and MgO having a major diameter of 5 μm or more in a steel pipe having an average time to failure of 720 hours or less in an SSC test.

FIG. 4 is an example of a ternary composition diagram of inclusions $Al_2O_3$, CaO, and MgO having a major diameter of 5 μm or more in a steel pipe that did not break all of the three test specimens in 1,500 hours in an SSC test.

DETAILED DESCRIPTION OF EMBODIMENTS OF THE INVENTION

Embodiments of the present invention are described below in detail.

A low-alloy high-strength seamless steel pipe for oil country tubular goods according to aspects of the present invention has a yield strength of 758 to 861 MPa, the steel pipe having a composition that contains, in mass %, C: 0.20 to 0.50%, Si: 0.01 to 0.35%, Mn: 0.45 to 1.5%, P: 0.020% or less, S: 0.002% or less, O: 0.003% or less, Al: 0.01 to 0.08%, Cu: 0.02 to 0.09%, Cr: 0.35 to 1.1%, Mo: 0.05 to 0.35%, B: 0.0010 to 0.0030%, Ca: 0.0010 to 0.0030%, Mg: 0.001% or less, and N: 0.005% or less, and in which the balance is Fe and incidental impurities, the steel pipe having a microstructure in which the number of oxide-base nonmetallic inclusions including CaO, $Al_2O_3$, and MgO and having a major diameter of 5 μm or more in the steel, and satisfying the composition ratios represented by the following formulae (1) and (2) is 20 or less per 100 $mm^2$, and in which the number of oxide-base nonmetallic inclusions including CaO, $Al_2O_3$, and MgO and having a major diameter of 5 μm or more in the steel, and satisfying the composition ratios represented by the following formulae (3) and (4) is 50 or less per 100 $mm^2$.

The composition may further contain, in mass %, one or more selected from Nb: 0.005 to 0.035%, V: 0.005 to 0.02%, W: 0.01 to 0.2%, and Ta: 0.01 to 0.3%.

The composition may further contain, in mass %, one or two selected from Ti: 0.003 to 0.10%, and Zr: 0.003 to 0.10%.

$$(CaO)/(Al_2O_3) \leq 0.25 \quad (1)$$

$$1.0 \leq (Al_2O_3)/(MgO) \leq 9.0 \quad (2)$$

$$(CaO)/(Al_2O_3) \geq 2.33 \quad (3)$$

$$(CaO)/(MgO) \geq 1.0 \quad (4)$$

In the formulae, (CaO), ($Al_2O_3$), and (MgO) represent the contents of CaO, $Al_2O_3$, and MgO, respectively, in the oxide-base nonmetallic inclusions in the steel, in mass %.

The following describe the reasons for specifying the chemical composition of a steel pipe according to aspects of the present invention. In the following, "%" means percent by mass, unless otherwise specifically stated.

C: 0.20 to 0.50%

C acts to increase steel strength, and is an important element for providing the desired high strength. C needs to be contained in an amount of 0.20% or more to achieve the high strength with a yield strength of 758 MPa or more in accordance with aspects of the present invention. With C content of more than 0.50%, the hardness does not decrease even after high-temperature tempering, and sensitivity to sulfide stress corrosion cracking resistance greatly decreases. For this reason, the C content is 0.20 to 0.50%. The C content is preferably 0.22% or more, more preferably 0.23% or more. The C content is preferably 0.35% or less, more preferably 0.27% or less.

Si: 0.01 to 0.35%

Si acts as a deoxidizing agent, and increases steel strength by forming a solid solution in the steel. Si is an element that reduces rapid softening during tempering. Si needs to be contained in an amount of 0.01% or more to obtain these effects. With Si content of more than 0.35%, formation of coarse oxide-base inclusions occurs, and these inclusions become initiation points of SSC. For this reason, the Si content is 0.01 to 0.35%. The Si content is preferably 0.02% or more. The Si content is preferably 0.15% or less, more preferably 0.04% or less.

Mn: 0.45 to 1.5%

Mn is an element that increases steel strength by improving hardenability, and prevents sulfur-induced embrittlement at grain boundaries by binding and fixing sulfur in the form of MnS. In accordance with aspects of the present invention, Mn content of 0.45% or more is required. When contained in an amount of more than 1.5%, Mn seriously increases the hardness of the steel, and the hardness does not decrease even after high-temperature tempering. This seriously impairs the sensitivity to sulfide stress corrosion cracking resistance. For this reason, the Mn content is 0.45 to 1.5%. The Mn content is preferably 0.70% or more, more preferably 0.90% or more. The Mn content is preferably 1.45% or less, more preferably 1.40% or less.

P: 0.020% or Less

P segregates at grain boundaries and other parts of the steel in a solid solution state, and tends to cause defects such as cracking due to grain boundary embrittlement. In accordance with aspects of the present invention, P is contained desirably as small as possible. However, P content of at most 0.020% is acceptable. For these reasons, the P content is 0.020% or less. The P content is preferably 0.018% or less, more preferably 0.015% or less.

S: 0.002% or Less

Most of the sulfur elements exist as sulfide-base inclusions in the steel, and impair ductility, toughness, and corrosion resistance, including sulfide stress corrosion cracking resistance. Some of the sulfur may exist in the form of a solid solution. However, in this case, S segregates at grain boundaries and other parts of the steel, and tends to cause defects such as cracking due to grain boundary embrittlement. For this reason, S is contained desirably as small as possible in accordance with aspects of the present invention. However, excessively small sulfur amounts increase the refining cost. For these reasons, the S content in accordance with aspects of the present invention is 0.002% or less, an amount with which the adverse effects of sulfur are tolerable. The S content is preferably 0.0014% or less.

O (Oxygen): 0.003% or Less

O (oxygen) exists as incidental impurities in the steel in the form of oxides of elements such as Al, Si, Mg, and Ca. When the number of oxides having a major diameter of 5 μm or more and satisfying the composition ratios represented by $(CaO)/(Al_2O_3)\leq 0.25$, and $1.0\leq(Al_2O_3)/(MgO)\leq 9.0$ is more than 20 per 100 $mm^2$, these oxides become initiation points of SSC that occurs on a test specimen surface, and breaks the specimen after extended time periods in an SSC test, as will be described later. When the number of oxides having a major diameter of 5 μm or more and satisfying the composition ratios represented by $(CaO)/(Al_2O_3)\leq 2.33$, and $(CaO)/(MgO)\leq 1.0$ is more than 50 per 100 $mm^2$, these oxides become initiation points of SSC that occurs from inside of a test specimen, and breaks the specimen in a short time period in an SSC test. For this reason, the O (oxygen) content is 0.003% or less, an amount with which the adverse effects of oxygen are tolerable. The O (oxygen) content is preferably 0.0022% or less, more preferably 0.0015% or less.

Al: 0.01 to 0.08%

Al acts as a deoxidizing agent, and contributes to reducing the solid solution nitrogen by forming AlN with N. Al needs to be contained in an amount of 0.01% or more to obtain these effects. With Al content of more than 0.08%, the cleanliness of the steel decreases, and, when the number of oxides having a major diameter of 5 μm or more and satisfying the composition ratios represented by $(CaO)/(Al_2O_3)\leq 0.25$, and $1.0\leq(Al_2O_3)/(MgO)\leq 9.0$ is more than 20 per 100 $mm^2$, these oxides become initiation points of SSC that occurs on a test piece specimen, and breaks the specimen after extended time periods in an SSC test, as will be described later. For this reason, the Al content is 0.01 to 0.08%, an amount with which the adverse effects of Al are tolerable. The Al content is preferably 0.025% or more, more preferably 0.050% or more. The Al content is preferably 0.075% or less, more preferably 0.070% or less.

Cu: 0.02 to 0.09%

Cu is an element that acts to improve corrosion resistance. When contained in trace amounts, Cu forms a dense corrosion product, and reduces generation and growth of pits, which become initiation points of SSC. This greatly improves the sulfide stress corrosion cracking resistance. For this reason, the required amount of Cu is 0.02% or more in accordance with aspects of the present invention. Cu content of more than 0.09% impairs hot workability in manufacture of a seamless steel pipe. For this reason, the Cu content is 0.02 to 0.09%. The Cu content is preferably 0.07% or less, more preferably 0.04% or less.

Cr: 0.35 to 1.1%

Cr is an element that contributes to increasing steel strength by way of improving hardenability, and improves corrosion resistance. Cr also forms carbides such as $M_3C$, $M_7C_3$, and $M_{23}C_6$ by binding to carbon during tempering. Particularly, the $M_3C$-base carbide improves resistance to softening in tempering, reduces strength changes in tempering, and contributes to the improvement of yield strength. In this way, Cr contributes to improving yield strength. Cr content of 0.35% or more is required to achieve the yield strength of 758 MPa or more in accordance with aspects of the present invention. A large Cr content of more than 1.1% is economically disadvantageous because the effect becomes saturated with these contents. For this reason, the Cr content is 0.35 to 1.1%. The Cr content is preferably 0.40% or more. The Cr content is preferably 0.90% or less, more preferably 0.80% or less.

Mo: 0.05 to 0.35%

When added in trace amounts, Mo contributes to increasing steel strength by way of improving hardenability, and improves corrosion resistance. The required Mo content for obtaining these effects is 0.05% or more. Mo content of more than 0.35% is economically disadvantageous because the effect becomes saturated with these contents. For this reason, the Mo content is 0.05 to 0.35%. The Mo content is preferably 0.25% or less, more preferably 0.15% or less.

B: 0.0010 to 0.0030%

B is an element that contributes to improving hardenability when contained in trace amounts. The required B content in accordance with aspects of the present invention is 0.0010% or more. B content of more than 0.0030% is economically disadvantageous because, in this case, the effect becomes saturated, or the expected effect may not be obtained because of formation of an iron borate (Fe—B). For this reason, the B content is 0.0010 to 0.0030%. The B content is preferably 0.0015% or more. The B content is preferably 0.0025% or less.

Ca: 0.0010 to 0.0030%

Ca is actively added to control the shape of oxide-base inclusions in the steel. As mentioned above, when the number of composite oxides having a major diameter of 5 μm or more and satisfying primarily $Al_2O_3$—MgO with a $(Al_2O_3)/(MgO)$ ratio of 1.0 to 9.0 is more than 20 per 100 $mm^2$, these oxides become initiation points of SSC that occurs on a test specimen surface, and breaks the specimen after extended time periods in an SSC test. In order to reduce generation of composite oxides of primarily $Al_2O_3$—MgO, aspects of the present invention require Ca content of 0.0010% or more. Ca content of more than 0.0030% causes increase in the number of oxides having a major diameter of 5 μm or more and satisfying the composition ratios represented by $(CaO)/(Al_2O_3)\leq 2.33$, and $(CaO)/(MgO)\leq 1.0$. These oxides become initiation points of SSC that occurs from inside of the test specimen, and breaks the specimen in a short time period in an SSC test. For this reason, the Ca content is 0.0010 to 0.0030%. The Ca content is preferably 0.0020% or less.

Mg: 0.001% or Less

Mg is not an actively added element. However, when reducing the S content in a desulfurization treatment using, for example, a ladle furnace (LF), Mg comes to be included as Mg component in the molten steel as a result of a reaction between a refractory having the MgO—C composition of a ladle, and CaO—$Al_2O_3$—$SiO_2$-base slug used for desulfurization. As mentioned above, when the number of composite oxides having a major diameter of 5 μm or more and satisfying primarily $Al_2O_3$—MgO with an $(Al_2O_3)/(MgO)$ ratio of 1.0 to 9.0 is more than 20 per 100 $mm^2$, these oxides become initiation points of SSC that occurs on a test specimen surface, and breaks the specimen after extended time periods in an SSC test. For this reason, the Mg content is 0.001% or less, an amount with which the adverse effects of Mg is tolerable. The Mg content is preferably 0.0008% or less, more preferably 0.0005% or less.

N: 0.005% or Less

N is contained as incidental impurities in the steel, and forms MN-type precipitate by binding to nitride-forming elements such as Ti, Nb, and Al. The excess nitrogen after the formation of these nitrides also forms BN precipitates by binding to boron. Here, it is desirable to reduce the excess nitrogen as much as possible because the excess nitrogen takes away the hardenability improved by adding boron. For this reason, the N content is 0.005% or less. The N content is preferably 0.004% or less.

The balance is Fe and incidental impurities in the composition above.

In accordance with aspects of the present invention, one or more selected from Nb: 0.005 to 0.035%, V: 0.005 to 0.02%, W: 0.01 to 0.2%, and Ta: 0.01 to 0.3% may be contained in the basic composition above for the purposes described below. The basic composition may also contain, in mass %, one or two selected from Ti: 0.003 to 0.10%, and Zr: 0.003 to 0.10%.

Nb: 0.005 to 0.035%

Nb is an element that delays recrystallization in the austenite (y) temperature region, and contributes to refining y grains. This makes niobium highly effective for refining of the lower structure (for example, packet, block, and lath) of steel immediately after quenching. Nb content of 0.005% or more is preferred for obtaining these effects. When contained in an amount of more than 0.035%, Nb seriously increases the hardness of the steel, and the hardness does not decrease even after high-temperature tempering. This may seriously impair the sensitivity to sulfide stress corrosion cracking resistance. For this reason, niobium, when contained, is contained in an amount of preferably 0.005 to 0.035%. The Nb content is more preferably 0.015% or more. The Nb content is more preferably 0.030% or less.

V: 0.005 to 0.02%

V is an element that contributes to strengthening the steel by forming carbides or nitrides. V is contained in an amount of preferably 0.005% or more to obtain this effect. When the V content is more than 0.02%, the V-base carbides may coarsen, and cause SSC by forming initiation points of sulfide stress corrosion cracking. For this reason, vanadium, when contained, is contained in an amount of preferably 0.005 to 0.02%. The V content is more preferably 0.010% or more. The V content is more preferably 0.015% or less.

W: 0.01 to 0.2%

W is also an element that contributes to strengthening the steel by forming carbides or nitrides. W is contained in an amount of preferably 0.01% or more to obtain this effect. When the W content is more than 0.2%, the W-base carbides may coarsen, and cause SSC by forming initiation points of sulfide stress corrosion cracking. For this reason, tungsten, when contained, is contained in an amount of preferably 0.01 to 0.2%. The W content is more preferably 0.03% or more. The W content is more preferably 0.1% or less.

Ta: 0.01 to 0.3%

Ta is also an element that contributes to strengthening the steel by forming carbides or nitrides. Ta is contained in an amount of preferably 0.01% or more to obtain this effect. When the Ta content is more than 0.3%, the Ta-base carbides may coarsen, and cause SSC by forming initiation points of sulfide stress corrosion cracking. For this reason, tantalum, when contained, is contained in an amount of preferably 0.01 to 0.3%. The Ta content is more preferably 0.04% or more. The Ta content is more preferably 0.2% or less.

Ti: 0.003 to 0.10%

Ti is an element that forms nitrides, and that contributes to preventing coarsening due to the pinning effect of austenite grains during quenching of the steel. Ti also improves sensitivity to hydrogen sulfide cracking resistance by making austenite grains smaller. Particularly, the austenite grains can have the required fineness without direct quenching (DQ) after hot rolling, as will be described later. Ti is contained in an amount of preferably 0.003% or more to obtain these effects. When the Ti content is more than 0.10%, the coarsened Ti-base nitrides may cause SSC by forming initiation points of sulfide stress corrosion cracking. For this reason, titanium, when contained, is contained in an amount of preferably 0.003 to 0.10%. The Ti content is more preferably 0.005% or more, further preferably 0.008% or more. The Ti content is more preferably 0.05% or less, further preferably 0.015% or less.

Zr: 0.003 to 0.10%

As with titanium, Zr forms nitrides, and improves sensitivity to hydrogen sulfide cracking resistance by preventing coarsening due to the pinning effect of austenite grains during quenching of the steel. This effect becomes more prominent when Zr is added with titanium. Zr is contained in an amount of preferably 0.003% or more to obtain these effects. When the Zr content is more than 0.10%, the coarsened Zr-base nitrides or Ti—Zr composite nitrides may cause SSC by forming initiation points of sulfide stress corrosion cracking. For this reason, zirconium, when contained, is contained in an amount of preferably 0.003 to 0.10%. The Zr content is more preferably 0.010% or more. The Zr content is more preferably 0.025% or less.

The following describes the inclusions in the steel with regard to the microstructure of the steel pipe according to aspects of the present invention.

Number of Oxide-Base nonmetallic inclusions including CaO, $Al_2O_3$, and MgO and having major diameter of 5 μm or more in the steel, and satisfying composition ratios represented by the following formulae (1) and (2) is 20 or less per 100 $mm^2$ $$(CaO)/(Al_2O_3) \leq 0.25 \quad (1)$$

$$1.0 \leq (Al_2O_3)/(MgO) \leq 9.0 \quad (2)$$

In the formulae, (CaO), $(Al_2O_3)$, and (MgO) represent the contents of CaO, $Al_2O_3$, and MgO, respectively, in the oxide-base nonmetallic inclusions in the steel, in mass %.

As described above, an SSC test was conducted for three test specimens from each steel pipe sample in each test bath for which a 24° C. mixed aqueous solution of 0.5 mass % $CH_3COOH$ and $CH_3COONa$ saturated with 0.01 MPa hydrogen sulfide gas was used, and that had an adjusted pH of 3.5 after the solution was saturated with hydrogen sulfide gas. The stress applied in the SSC test was 90% of the actual yield strength of the steel pipe. As shown in FIG. 2, the ternary composition of the inclusions $Al_2O_3$, CaO, and MgO having a major diameter of 5 μm or more in a steel pipe that had an average time to failure of more than 720 hours in the SSC test contained large numbers of inclusions with a large fraction of $Al_2O_3$ in the $(CaO)/(Al_2O_3)$ ratio and also in the $(Al_2O_3)/(MgO)$ ratio. Formulae (1) and (2) quantitatively represent these ranges. By comparing the number of inclusions of 5 μm or more with that in the composition of the same inclusions in a steel pipe that did not show any failure in any of the test specimens in 1,500 hours in an SSC test, it was found that a test specimen does not break in 1,500 hours when the number of inclusions is 20 or less per 100 $mm^2$. Accordingly, the specified number of oxide-base nonmetallic inclusions including CaO, $Al_2O_3$, and MgO and having a major diameter of 5 μm or more in the steel, and satisfying the formulae (1) and (2) is 20 or less per 100 $mm^2$, preferably 10 or less. The reason that the inclusions having a major diameter of 5 μm or more and satisfying the formulae (1) and (2) have adverse effect on sulfide stress corrosion cracking resistance is probably because, when the inclusions of such a composition are exposed on a test specimen surface, the inclusions themselves dissolve in the test bath, and, after about 720 hours of gradual progression of pitting corrosion, the amount of the hydrogen that entered the steel pipe through areas affected by pitting corrosion accumulates, and exceeds an amount enough to cause SSC, before eventually breaking the specimen.

Number of Oxide-Base nonmetallic inclusions including CaO, $Al_2O_3$, and MgO and having major diameter of 5 μm or more in the Steel, and satisfying composition ratios represented by the following formulae (3) and (4) is 50 or less per 100 $mm^2$ $$(CaO)/(Al_2O_3) \leq 2.33 \quad (3)$$

$$(CaO)/(MgO) \leq 1.0 \quad (4)$$

In the formulae, (CaO), ($Al_2O_3$), and (MgO) represent the contents of CaO, $Al_2O_3$, and MgO, respectively, in the oxide-base nonmetallic inclusions in the steel, in mass %.

As described above, an SSC test was conducted for three test specimens from each steel pipe sample in each test bath for which a 24° C. mixed aqueous solution of 0.5 mass % $CH_3COOH$ and $CH_3COONa$ saturated with 0.01 MPa hydrogen sulfide gas was used, and that had an adjusted pH of 3.5 after the solution was saturated with hydrogen sulfide gas. The stress applied in the SSC test was 90% of the actual yield strength of the steel pipe. As shown in FIG. 3, the ternary composition of the inclusions $Al_2O_3$, CaO, and MgO having a major diameter of 5 μm or more in a steel pipe that had an average time to failure of 720 hours or less in the SSC test contained large numbers of inclusions with a large fraction of CaO in the (CaO)/($Al_2O_3$) ratio and also in the (CaO)/(MgO) ratio. Formulae (3) and (4) quantitatively represent these ranges. By comparing the number of inclusions of 5 μm or more with that in the composition of the same inclusions in a steel pipe that did not show any breakage in any of the test specimens in 1,500 hours in an SSC test, it was found that a test specimen does not break in 1,500 hours when the number of inclusions is 50 or less per 100 $mm^2$. Accordingly, the specified number of oxide-base nonmetallic inclusions including CaO, $Al_2O_3$, and MgO and having a major diameter of 5 μm or more in the steel, and satisfying the formulae (3) and (4) is 50 or less per 100 $mm^2$, preferably 30 or less. The inclusions having a major diameter of 5 μm or more and satisfying the formulae (3) and (4) have adverse effect on sulfide stress corrosion cracking resistance probably because the inclusions become very coarse as the fraction of CaO in the (CaO)/($Al_2O_3$) ratio increases, and raises the formation temperature of the inclusions in the molten steel. In an SSC test, the interface between these coarse inclusions and the base metal becomes an initiation point of SSC, and SSC occurs at an increased rate from inside of the test specimen before eventually breaking the specimen.

The following describes a method for manufacturing the low-alloy high-strength seamless steel pipe for oil country tubular goods having excellent sulfide stress corrosion cracking resistance (SSC resistance).

In accordance with aspects of the present invention, the method of production of a steel pipe material of the composition above is not particularly limited. For example, a molten steel of the foregoing composition is made into steel using an ordinary steel making process such as by using a converter, an electric furnace, and a vacuum melting furnace, and formed into a steel pipe material, for example, a billet, using an ordinary method such as continuous casting, and ingot casting-blooming.

In order to achieve the specified number of oxide-base nonmetallic inclusions including CaO, $Al_2O_3$, and MgO and having a major diameter of 5 μm or more and the two compositions above in the steel, it is preferable to perform a deoxidation treatment using Al, immediately after making a steel using a commonly known steel making process such as by using a converter, an electric furnace, or a vacuum melting furnace. In order to reduce S (sulfur) in the molten steel, it is preferable that the deoxidation treatment be followed by a desulfurization treatment such as by using a ladle furnace (LF), and that the N and O (oxygen) in the molten steel be reduced with a degassing device, before adding Ca, and finally casting the steel. It is preferable that the concentration of impurity including Ca in the raw material alloy used for the LF and degassing process be controlled and reduced as much as possible so that the Ca concentration in the molten steel after degassing and before addition of Ca falls in a range of 0.0010 mass % or less. When the Ca concentration in the molten steel before addition of Ca is more than 0.0010 mass %, the Ca concentration in the molten steel undesirably increases when Ca is added in the appropriate amount [% Ca*] in the Ca adding process described below. This increases the number of CaO—$Al_2O_3$—MgO composite oxides having a high CaO ratio, and a (CaO)/(MgO) ratio of 1.0 or more. These oxides become initiation points of SSC, and SSC occurs from inside of the test specimen in a short time period, and breaks the specimen in an SSC test. When adding Ca in the Ca adding process after degassing, it is preferable to add Ca in an appropriate concentration (an amount relative to the weight of the molten steel; [% Ca*]) according to the oxygen [% T.O] value of the molten steel. For example, an appropriate Ca concentration [% Ca*] can be decided according to the oxygen [% T.O] value of molten steel derived after an analysis performed immediately after degassing, using the following formula (5).

$$0.63 \leq [\%\ Ca^*]/[\%\ T.O] \leq 0.91 \quad (5)$$

Here, when the [% Ca*]/[% T.O] ratio is less than 0.63, it means that the added amount of Ca is too small, and, accordingly, there will be an increased number of composite oxides of primarily $Al_2O_3$—MgO having a small CaO ratio, and a ($Al_2O_3$)/(MgO) ratio of 1.0 to 9.0, even when the Ca value in the steel pipe falls within the range of the present invention. These oxides become initiation points of SSC, and SSC occurs on a test specimen surface after extended time periods, and breaks the specimen in an SSC test. When the [% Ca*]/[% T.O] ratio is more than 0.91, there will be an increased number of CaO—$Al_2O_3$—MgO composite oxides having a high CaO ratio, and a (CaO)/(MgO) ratio of 1.0 or more. These oxides become initiation points of SSC, and SSC occurs from inside of the test specimen in a short time period, and breaks the specimen in an SSC test.

The resulting steel pipe material is formed into a seamless steel pipe by hot forming. A commonly known method may be used for hot forming. In exemplary hot forming, the steel pipe material is heated, and, after being pierced with a piercer, formed into a predetermined wall thickness by mandrel mill rolling or plug mill rolling, before being hot rolled into an appropriately reduced diameter. Here, the heating temperature of the steel pipe material is preferably 1,150 to 1,280° C. With a heating temperature of less than 1,150° C., the deformation resistance of the heated steel pipe material increases, and the steel pipe material cannot be properly pierced. When the heating temperature is more than 1,280° C., the microstructure seriously coarsens, and it becomes difficult to produce fine grains during quenching (described later). The heating temperature is more preferably 1,200° C. or more. The rolling stop temperature is preferably 750 to 1,100° C. When the rolling stop temperature is less than 750° C., the applied load of the reduction rolling increases, and the steel pipe material cannot be properly formed. When the rolling stop temperature is more than 1,100° C., the rolling recrystallization fails to produce sufficiently fine grains, and it becomes difficult to produce fine grains during quenching (described later). The rolling stop temperature is preferably 850° C. or more, and is preferably 1,050° C. or less. From the viewpoint of producing fine grains, it is preferable in accordance with aspects of the present invention that the hot rolling be followed by direct quenching (DQ) when Ti or Zr are not added.

After being formed, the seamless steel pipe is subjected to quenching (Q) and tempering (T) to achieve the yield strength of 758 MPa or more in accordance with aspects of the present invention. From the viewpoint of producing fine grains, the quenching temperature is preferably 930° C. or less. When the quenching temperature is less than 860° C., secondary precipitation hardening elements such as Mo, V, W, and Ta fail to sufficiently form solid solutions, and the amount of secondary precipitates becomes insufficient after tempering. For this reason, the quenching temperature is preferably 860 to 930° C. The quenching temperature is preferably 870° C. or more, and is preferably 900° C. or less. The tempering temperature needs to be equal to or less than the $Ac_1$ temperature to avoid austenite retransformation. However, the carbides of Cr and Mo, or V, W, or Ta fail to precipitate in sufficient amounts in secondary precipitation when the tempering temperature is less than 500° C. For this reason, the tempering temperature is preferably 500° C. or more. Particularly, the final tempering temperature is preferably 540° C. or more, and is preferably 640° C. or less. In order to improve sensitivity to hydrogen sulfide cracking resistance through formation of fine grains, quenching (Q) and tempering (T) may be repeated. When DQ is not applicable after hot rolling, the effect of DQ may be produced by addition of Ti or Zr, or by repeating quenching and tempering at least two times with a quenching temperature of 950° C. or more, particularly for the first quenching.

EXAMPLES

Aspects of the present invention are described below in greater detail through Examples. It should be noted that the present invention is not limited by the following Examples.

Example 1

The steels of the compositions shown in Table 1 were prepared using a converter process. Immediately after Al deoxidation, the steels were subjected to secondary refining in order of LF and degassing, and Ca was added. Finally, the steels were continuously cast to produce steel pipe materials. Here, high-purity raw material alloys containing no impurity including Ca were used for Al deoxidation, LF, and degassing, with some exceptions. After degassing, molten steel samples were taken, and analyzed for Ca in the molten steel. The analysis results are presented in Tables 2-1 and 2-2. With regard to the Ca adding process, a [% Ca*]/[% T.O] ratio was calculated, where [% T.O] is the analyzed value of oxygen in the molten steel, and [% Ca*] is the amount of Ca added with respect to the weight of molten steel. The results are presented in Tables 2-1 and 2-2.

The steels were subjected to two types of continuous casting: round billet continuous casting that produces a round cast piece having a circular cross section, and bloom continuous casting that produces a cast piece having a rectangular cross section. The cast piece produced by bloom continuous casting was reheated at 1,200° C., and rolled into a round billet. In Tables 2-1 and 2-2, the round billet continuous casting is denoted as "directly cast billet", and a round billet obtained after rolling is denoted as "rolled billet". These round billet materials were hot rolled into seamless steel pipes with the billet heating temperatures and the rolling stop temperatures shown in Tables 2-1 and 2-2. The seamless steel pipes were then subjected to heat treatment at the quenching (Q) temperatures and the tempering (T) temperatures shown in Tables 2-1 and 2-2. Some of the seamless steel pipes were directly quenched (DQ), whereas other seamless steel pipes were subjected to heat treatment after being air cooled.

After the final tempering, a sample having a 13 mm×13=surface for investigation of inclusions was obtained from the center in the wall thickness of the steel pipe at an arbitrarily chosen circumferential location at an end of the steel pipe. A tensile test specimen and an SSC test specimen were also taken. For the SSC test, three test specimens were taken from each steel pipe sample. These were evaluated as follows.

The sample for investigating inclusions was mirror polished, and observed for inclusions in a 10 mm×10 mm region, using a scanning electron microscope (SEM). The chemical composition of the inclusions was analyzed with a characteristic X-ray analyzer equipped in the SEM, and the contents were calculated in mass %. Inclusions having a major diameter of 5 μm or more and satisfying the composition ratios of formulae (1) and (2), and inclusions having a major diameter of 5 μm or more and satisfying the composition ratios of formulae (3) and (4) were counted. The results are presented in Tables 2-1 and 2-2.

The tensile test specimen was subjected to a JIS 22241 tensile test, and the yield strength was measured. The yield strengths of the steel pipes tested are presented in Tables 2-1 and 2-2. Steel pipes that had a yield strength of 758 MPa or more and 861 MPa or less were determined as being acceptable.

The SSC test specimen was subjected to an SSC test according to NACE TM0177, method A. A 24° C. mixed aqueous solution of 0.5 mass % $CH_3COOH$ and $CH_3COONa$ saturated with 0.1 atm (=0.01 MPa) hydrogen sulfide gas was used as a test bath. The test bath was adjusted so that it had a pH of 3.5 after the solution was saturated with hydrogen sulfide gas. The stress applied in the SSC test was 90% of the actual yield strength of the steel pipe. The test was conducted for 1,500 hours. For samples that did not break in 1,500 hours, the test was continued until the pipe broke, or 3,000 hours. The time to failure for the three SSC test specimens of each steel pipe is presented in Tables 2-1 and 2-2. Steels were determined as being acceptable when all of the three test specimens had a time to failure of 1,500 hours or more in the SSC test. The time to failure is "3,000" for steel pipes that did not break in 3,000 hours.

TABLE 1

| Steel No. | Chemical composition (mass %) | | | | | | | | | | |
|---|---|---|---|---|---|---|---|---|---|---|---|
| | C | Si | Mn | P | S | O | Al | Cu | Cr | Mo | B |
| A | 0.23 | 0.04 | 0.91 | 0.014 | 0.0013 | 0.0012 | 0.068 | 0.04 | 0.76 | 0.06 | 0.0018 |
| B | 0.24 | 0.03 | 0.90 | 0.013 | 0.0011 | 0.0013 | 0.067 | 0.03 | 0.77 | 0.07 | 0.0022 |
| C | 0.23 | 0.04 | 0.92 | 0.013 | 0.0014 | 0.0011 | 0.069 | 0.03 | 0.77 | 0.05 | 0.0019 |
| D | 0.24 | 0.04 | 0.92 | 0.012 | 0.0016 | 0.0015 | 0.066 | 0.02 | 0.75 | 0.06 | 0.0016 |
| E | 0.24 | 0.02 | 0.91 | 0.014 | 0.0012 | 0.0014 | 0.068 | 0.04 | 0.78 | 0.07 | 0.0018 |
| F | 0.27 | 0.04 | 1.39 | 0.011 | 0.0013 | 0.0012 | 0.070 | 0.03 | 0.51 | 0.09 | 0.0024 |
| G | 0.25 | 0.02 | 1.22 | 0.013 | 0.0012 | 0.0014 | 0.069 | 0.04 | 0.41 | 0.14 | 0.0017 |
| H | 0.26 | 0.03 | 0.48 | 0.018 | 0.0017 | 0.0021 | 0.056 | 0.07 | 1.05 | 0.06 | 0.0011 |
| I | 0.21 | 0.34 | 1.48 | 0.016 | 0.0016 | 0.0023 | 0.077 | 0.08 | 0.36 | 0.18 | 0.0027 |
| J | 0.47 | 0.14 | 0.52 | 0.019 | 0.0018 | 0.0022 | 0.079 | 0.06 | 0.89 | 0.09 | 0.0012 |
| K | 0.24 | 0.01 | 1.02 | 0.011 | 0.0009 | 0.0013 | 0.066 | 0.03 | 0.59 | 0.12 | 0.0016 |
| L | 0.31 | 0.02 | 0.74 | 0.016 | 0.0015 | 0.0025 | 0.039 | 0.07 | 0.38 | 0.33 | 0.0011 |
| M | 0.27 | 0.04 | 0.97 | 0.009 | 0.0011 | 0.0012 | 0.068 | 0.02 | 0.44 | 0.08 | 0.0019 |
| N | 0.58 | 0.27 | 0.89 | 0.012 | 0.0011 | 0.0014 | 0.067 | 0.03 | 0.74 | 0.07 | 0.0021 |
| O | 0.17 | 0.03 | 0.88 | 0.013 | 0.0012 | 0.0013 | 0.069 | 0.04 | 0.75 | 0.06 | 0.0024 |
| P | 0.24 | 0.06 | 1.62 | 0.015 | 0.0017 | 0.0018 | 0.070 | 0.04 | 0.74 | 0.06 | 0.0017 |
| Q | 0.23 | 0.05 | 0.41 | 0.016 | 0.0015 | 0.0015 | 0.071 | 0.03 | 0.73 | 0.08 | 0.0019 |
| R | 0.23 | 0.04 | 0.91 | 0.025 | 0.0018 | 0.0012 | 0.069 | 0.04 | 0.75 | 0.07 | 0.0022 |
| S | 0.24 | 0.07 | 0.89 | 0.014 | 0.0029 | 0.0016 | 0.072 | 0.03 | 0.76 | 0.05 | 0.0018 |
| T | 0.23 | 0.04 | 0.90 | 0.017 | 0.0014 | 0.0037 | 0.068 | 0.05 | 0.74 | 0.07 | 0.0027 |
| U | 0.23 | 0.08 | 0.88 | 0.011 | 0.0019 | 0.0017 | 0.098 | 0.06 | 0.75 | 0.06 | 0.0023 |
| V | 0.28 | 0.02 | 0.92 | 0.013 | 0.0016 | 0.0011 | 0.066 | 0.02 | 0.31 | 0.09 | 0.0014 |
| W | 0.27 | 0.09 | 0.89 | 0.018 | 0.0013 | 0.0019 | 0.065 | 0.03 | 0.78 | 0.03 | 0.0029 |
| X | 0.29 | 0.08 | 0.93 | 0.014 | 0.0014 | 0.0014 | 0.068 | 0.04 | 0.77 | 0.08 | 0.0007 |
| Y | 0.23 | 0.05 | 0.90 | 0.014 | 0.0015 | 0.0014 | 0.071 | 0.03 | 0.74 | 0.07 | 0.0015 |
| Z | 0.24 | 0.06 | 0.89 | 0.013 | 0.0012 | 0.0018 | 0.069 | 0.04 | 0.76 | 0.07 | 0.0021 |

| Steel No. | Chemical composition (mass %) | | | | | | | Classification |
|---|---|---|---|---|---|---|---|---|
| | Ca | Mg | N | Nb* | V* | W* | Ta* | |
| A | 0.0018 | 0.0004 | 0.0036 | — | — | — | — | Compliant Example |
| B | 0.0034 | 0.0003 | 0.0042 | — | — | — | — | Comparative Example |
| C | 0.0026 | 0.0005 | 0.0048 | — | — | — | — | Compliant Example |
| D | 0.0012 | 0.0008 | 0.0043 | — | — | — | — | Compliant Example |
| E | 0.0006 | 0.0007 | 0.0039 | — | — | — | — | Comparative Example |
| F | 0.0017 | 0.0004 | 0.0037 | — | — | — | — | Compliant Example |
| G | 0.0016 | 0.0003 | 0.0035 | — | — | — | — | Compliant Example |
| H | 0.0013 | 0.0009 | 0.0044 | 0.032 | — | — | — | Compliant Example |
| I | 0.0016 | 0.0008 | 0.0047 | — | 0.017 | — | — | Compliant Example |
| J | 0.0012 | 0.0007 | 0.0031 | — | — | 0.18 | — | Compliant Example |
| K | 0.0013 | 0.0002 | 0.0029 | — | — | — | 0.14 | Compliant Example |
| L | 0.0012 | 0.0009 | 0.0046 | 0.012 | — | 0.04 | — | Compliant Example |
| M | 0.0014 | 0.0003 | 0.0026 | — | 0.011 | 0.09 | — | Compliant Example |
| N | 0.0016 | 0.0005 | 0.0033 | — | — | — | — | Comparative Example |
| O | 0.0013 | 0.0006 | 0.0027 | — | — | — | — | Comparative Example |
| P | 0.0019 | 0.0004 | 0.0041 | — | — | — | — | Comparative Example |
| Q | 0.0018 | 0.0005 | 0.0044 | — | — | — | — | Comparative Example |
| R | 0.0015 | 0.0008 | 0.0024 | — | — | — | — | Comparative Example |
| S | 0.0017 | 0.0007 | 0.0031 | — | — | — | — | Comparative Example |
| T | 0.0016 | 0.0005 | 0.0028 | — | — | — | — | Comparative Example |
| U | 0.0014 | 0.0003 | 0.0028 | — | — | — | — | Comparative Example |
| V | 0.0012 | 0.0009 | 0.0047 | — | — | — | — | Comparative Example |
| W | 0.0019 | 0.0002 | 0.0026 | — | — | — | — | Comparative Example |
| X | 0.0012 | 0.0007 | 0.0021 | — | — | — | — | Comparative Example |
| Y | 0.0016 | 0.0022 | 0.0045 | — | — | — | — | Comparative Example |
| Z | 0.0015 | 0.0006 | 0.0071 | — | — | — | — | Comparative Example |

※1: Underline means outside the range of the invention

※2: *represents a selective element

TABLE 2-1

| Steel pipe No. | Steel No. | Conditions for adding Ca in steelmaking | | Billet formation | Wall thickness (mm) | Outer diameter (mm) | Steel pipe rolling conditions | | | Steel pipe heat treatment |
|---|---|---|---|---|---|---|---|---|---|---|
| | | Percentage of Ca in molten steel after RH (mass %) | [% Ca*]/[% T.O] | Directly cast billet or rolled billet | | | Billet heating (° C.) | Rolling stop temp. (° C.) | Post-rolling cooling | conditions Q1 temp. (° C.) |
| 1-1 | A | 0.0003 | 0.69 | Directly cast billet | 13.8 | 245 | 1278 | 944 | DQ | 885 |
| 1-2 | B | 0.0004 | 0.98 | Directly cast billet | 13.8 | 245 | 1277 | 939 | DQ | 887 |

TABLE 2-1-continued

| | | | | | | | | | | |
|---|---|---|---|---|---|---|---|---|---|---|
| 1-3 | C | 0.0013 | 0.94 | Directly cast billet | 13.8 | 245 | 1279 | 941 | DQ | 886 |
| 1-4 | D | 0.0002 | 0.52 | Directly cast billet | 13.8 | 245 | 1276 | 943 | DQ | 884 |
| 1-5 | E | 0.0001 | 0.37 | Directly cast billet | 13.8 | 245 | 1278 | 942 | DQ | 885 |
| 1-6 | F | 0.0002 | 0.73 | Directly cast billet | 24.5 | 311 | 1271 | 1002 | Air cooling | 959 |
| 1-7 | G | 0.0001 | 0.77 | Rolled billet | 28.9 | 311 | 1219 | 924 | DQ | 871 |
| 1-8 | H | 0.0003 | 0.64 | Rolled billet | 24.5 | 311 | 1269 | 997 | Air cooling | 962 |
| 1-9 | I | 0.0004 | 0.66 | Directly cast billet | 28.9 | 311 | 1221 | 929 | DQ | 883 |
| 1-10 | J | 0.0002 | 0.65 | Directly cast billet | 38.1 | 216 | 1203 | 897 | Air cooling | 951 |
| 1-11 | K | 0.0003 | 0.83 | Directly cast billet | 24.5 | 311 | 1272 | 904 | DQ | 898 |
| 1-12 | L | 0.0002 | 0.64 | Directly cast billet | 28.9 | 311 | 1218 | 933 | DQ | 889 |
| 1-13 | M | 0.0004 | 0.79 | Rolled billet | 28.9 | 311 | 1220 | 931 | DQ | 877 |

| | | Steel pipe heat treatment conditions | | | Number of inclusions of 5 μm or more | Number of inclusions of 5 μm or more | | Time to failure in SSC test in 0.01 MPa $H_2S$ | |
|---|---|---|---|---|---|---|---|---|---|
| Steel pipe No. | Steel No. | T1 temp. (° C.) | Q2 temp. (° C.) | T2 temp. (° C.) | satisfying formulae (1) and (2) (per 100 $mm^2$) | satisfying formulae (3) and (4) (per 100 $mm^2$) | Yield strength (MPa) | saturated pH 3.5 solution (N = 3) (hr) | Remarks |
| 1-1 | A | 598 | — | — | 5 | 18 | 799 | 3000<br>3000<br>3000 | Present Example |
| 1-2 | B | 599 | — | — | 0 | 73 | 798 | 244<br>297<br>333 | Comparative Example |
| 1-3 | C | 597 | — | — | 2 | 56 | 801 | 359<br>366<br>391 | Comparative Example |
| 1-4 | D | 601 | — | — | 23 | 8 | 797 | 1291<br>1341<br>2816 | Comparative Example |
| 1-5 | E | 599 | — | — | 32 | 3 | 800 | 1037<br>1124<br>1244 | Comparative Example |
| 1-6 | F | 504 | 879 | 574 | 5 | 22 | 765 | 3000<br>3000<br>3000 | Present Example |
| 1-7 | G | 566 | — | — | 9 | 21 | 777 | 3000<br>3000<br>3000 | Present Example |
| 1-8 | H | 509 | 893 | 569 | 15 | 11 | 859 | 2479<br>2773<br>2814 | Present Example |
| 1-9 | I | 557 | — | — | 16 | 12 | 822 | 2557<br>2819<br>3000 | Present Example |
| 1-10 | J | 512 | 893 | 549 | 17 | 19 | 846 | 1964<br>2085<br>2922 | Present Example |
| 1-11 | K | 544 | 888 | 581 | 6 | 9 | 853 | 3000<br>3000<br>3000 | Present Example |
| 1-12 | L | 561 | — | — | 13 | 15 | 834 | 2675<br>2837<br>3000 | Present Example |
| 1-13 | M | 509 | 891 | 568 | 8 | 17 | 812 | 3000<br>3000<br>3000 | Present Example |

※1: Underline means outside the range of the invention

※2: Formula (1): $(CaO)/(Al_2O_3) \leq 0.25$; Formula (2): $1.0 \leq (Al_2O_3)/(MgO) \leq 9.0$; Formula (3): $(CaO)/(Al_2O_3) \geq 2.33$; Formula (4): $(CaO)/(MgO) \geq 1.0$ In the formulae, (CaO), $(Al_2O_3)$, and (MgO) represent the contents of CaO, $Al_2O_3$, and MgO, respectively, in the oxide-base nonmetallic inclusions in the steel, in mass %.

TABLE 2-2

| Steel pipe No. | Steel No. | Conditions for adding Ca in steelmaking: Percentage of Ca in molten steel after RH (mass %) | [% Ca*]/[% T.O] | Billet formation: Directly cast billet or rolled billet | Wall thickness (mm) | Outer diameter (mm) | Steel pipe rolling conditions: Billet heating (° C.) | Rolling stop temp. (° C.) | Post-rolling cooling | Steel pipe heat treatment conditions Q1 temp. (° C.) |
|---|---|---|---|---|---|---|---|---|---|---|
| 1-14 | N | 0.0009 | 0.81 | Directly cast billet | 13.8 | 245 | 1276 | 945 | DQ | 888 |
| 1-15 | O | 0.0008 | 0.84 | Directly cast billet | 13.8 | 245 | 1277 | 946 | DQ | 887 |
| 1-16 | P | 0.0007 | 0.76 | Directly cast billet | 13.8 | 245 | 1278 | 944 | DQ | 888 |
| 1-17 | Q | 0.0009 | 0.78 | Directly cast billet | 13.8 | 245 | 1277 | 944 | DQ | 886 |
| 1-18 | R | 0.0004 | 0.82 | Directly cast billet | 13.8 | 245 | 1276 | 945 | DQ | 886 |
| 1-19 | S | 0.0008 | 0.73 | Directly cast billet | 13.8 | 245 | 1277 | 946 | DQ | 887 |
| 1-20 | T | 0.0002 | 0.65 | Directly cast billet | 13.8 | 245 | 1279 | 946 | DQ | 885 |
| 1-21 | U | 0.0001 | 0.63 | Directly cast billet | 13.8 | 245 | 1278 | 943 | DQ | 888 |
| 1-22 | V | 0.0005 | 0.89 | Directly cast billet | 13.8 | 245 | 1278 | 945 | DQ | 889 |
| 1-23 | W | 0.0006 | 0.85 | Directly cast billet | 13.8 | 245 | 1277 | 944 | DQ | 888 |
| 1-24 | X | 0.0003 | 0.83 | Directly cast billet | 13.8 | 245 | 1278 | 945 | DQ | 889 |
| 1-25 | Y | 0.0002 | 0.64 | Directly cast billet | 13.8 | 245 | 1276 | 946 | DQ | 886 |
| 1-26 | Z | 0.0008 | 0.73 | Directly cast billet | 13.8 | 245 | 1277 | 947 | DQ | 887 |

| Steel pipe No. | Steel No. | Steel pipe heat treatment conditions: T1 temp. (° C.) | Q2 temp. (° C.) | T2 temp. (° C.) | Number of inclusions of 5 μm or more satisfying formulae (1) and (2) (per 100 mm$^2$) | Number of inclusions of 5 μm or more satisfying formulae (3) and (4) (per 100 mm$^2$) | Yield strength (MPa) | Time to failure in SSC test in 0.01 MPa $H_2S$ saturated pH 3.5 solution (N = 3) (hr) | Remarks |
|---|---|---|---|---|---|---|---|---|---|
| 1-14 | N | 601 | — | — | 7 | 24 | 859 | 126<br>273<br>281 | Comparative Example |
| 1-15 | O | 599 | — | — | 6 | 29 | 632 | 3000<br>3000<br>3000 | Comparative Example |
| 1-16 | P | 600 | — | — | 8 | 22 | 855 | 242<br>279<br>291 | Comparative Example |
| 1-17 | Q | 598 | — | — | 5 | 26 | 649 | 3000<br>3000<br>3000 | Comparative Example |
| 1-18 | R | 597 | — | — | 7 | 31 | 804 | 287<br>449<br>586 | Comparative Example |
| 1-19 | S | 598 | — | — | 9 | 27 | 791 | 224<br>302<br>366 | Comparative Example |
| 1-20 | T | 599 | — | — | 22 | 53 | 798 | 199<br>297<br>381 | Comparative Example |
| 1-21 | U | 601 | — | — | 24 | 11 | 801 | 1224<br>1299<br>1361 | Comparative Example |
| 1-22 | V | 600 | — | — | 9 | 25 | 699 | 3000<br>3000<br>3000 | Comparative Example |
| 1-23 | W | 597 | — | — | 8 | 19 | 687 | 493<br>551<br>603 | Comparative Example |
| 1-24 | X | 598 | — | — | 9 | 28 | 646 | 3000<br>3000<br>3000 | Comparative Example |

TABLE 2-2-continued

| | | | | | | | | | |
|---|---|---|---|---|---|---|---|---|---|
| 1-25 | Y | 602 | — | — | 28 | 19 | 797 | 1377<br>1392<br>1448 | Comparative Example |
| 1-26 | Z | 599 | — | — | 6 | 27 | 639 | 3000<br>3000<br>3000 | Comparative Example |

※1: Underline means outside the range of the invention

※2: Formula (1): $(CaO)/(Al_2O_3) \leq 0.25$; Formula (2): $1.0 \leq (Al_2O_3)/(MgO) \leq 9.0$; Formula (3): $(CaO)/(Al_2O_3) \geq 2.33$; Formula (4): $(CaO)/(MgO) \geq 1.0$ In the formulae, (CaO), $(Al_2O_3)$, and (MgO) represent the contents of CaO, $Al_2O_3$, and MgO, respectively, in the oxide-base nonmetallic inclusions in the steel, in mass %.

The yield strength was 758 MPa or more and 861 MPa or less, and the time to failure for all the three test specimens tested in the SSC test was 1,500 hours or more in the present examples (steel pipe No. 1-1, and steel pipe Nos. 1-6 to 1-13) that had the chemical compositions within the range of the present invention, and in which the number of inclusions having a major diameter of 5 μm or more and a composition satisfying the formulae (1) and (2), and the number of inclusions having a major diameter of 5 μm or more and a composition satisfying the formulae (3) and (4) fell within the ranges of the present invention.

In contrast, all of the three test specimens tested in the SSC test broke within 1,500 hours in Comparative Example (steel pipe No. 1-2) in which the Ca in the chemical composition was above the range of the present invention, and in Comparative Example (steel pipe No. 1-3) in which the number of inclusions having a major diameter of 5 μm or more and satisfying the composition ratios of formulae (3) and (4) fell outside the range of the present invention because of the high Ca concentration in the molten steel after degassing, and the [% Ca*]/[% T.O] ratio of more than 0.91 after the addition of calcium.

At least two of the three test specimens tested in the SSC test broke within 1,500 hours in Comparative Example (steel pipe No. 1-4) in which the number of inclusions having a major diameter of 5 μm or more and satisfying the composition ratios of formulae (1) and (2) fell outside the range of the present invention because of the [% Ca*]/[% T.O] ratio of less than 0.63 after the addition of calcium, and in Comparative Example (steel pipe No. 1-5) in which Ca was below the range of the present invention, and in which the number of inclusions having a major diameter of 5 μm or more and satisfying the composition ratios of formulae (1) and (2) fell outside the range of the present invention because of the [% Ca*]/[% T.O] ratio of less than 0.63 after the addition of calcium.

All of the three test specimens tested in the SSC test broke within 1,500 hours in Comparative Examples (steel pipe Nos. 1-14 and 1-16) in which C and Mn in the chemical composition were above the ranges of the present invention, and, as a result, the steel pipes maintained their high strength even after high-temperature tempering.

Comparative Examples (steel pipe Nos. 1-15, 1-17, 1-22, 1-23, and 1-24) in which C, Mn, Cr, Mo, and B in the chemical composition were below the ranges of the present invention failed to achieve the target yield strength.

All of the three test specimens tested in the SSC test broke within 1,500 hours in Comparative Examples (steel pipe Nos. 1-18 and 1-19) in which P and S in the chemical composition were above the ranges of the present invention.

All of the three test specimens tested in the SSC test broke within 1,500 hours in Comparative Example (steel pipe No. 1-20) in which O (oxygen) in the chemical composition was above the range of the present invention, and in which the number of inclusions having a major diameter of 5 μm or more and satisfying the composition ratios of formulae (1) and (2), and the number of inclusions having a major diameter of 5 μm or more and satisfying the composition ratios of formulae (3) and (4) fell outside the ranges of the present invention.

All of the three test specimens tested in the SSC test broke within 1,500 hours in Comparative Example (steel pipe No. 1-21) in which Al in the chemical composition was above the range of the present invention, and in which the number of inclusions having a major diameter of 5 μm or more and satisfying the composition ratios of formulae (1) and (2) fell outside the range of the present invention.

All of the three test specimens tested in the SSC test broke within 1,500 hours in Comparative Example (steel pipe No. 1-25) in which Mg in the chemical composition was above the range of the present invention, and in which number of inclusions having a major diameter of 5 μm or more and a composition satisfying formulae (1) and (2) fell outside the range of the present invention.

In Comparative Example (steel pipe No. 1-26) in which N in the chemical composition was above the range of the present invention, the excess nitrogen formed BN with boron, and the hardenability was poor due to an insufficient amount of solid solution boron. Accordingly, this steel pipe failed to achieve the target yield strength.

Example 2

The steels of the compositions shown in Table 3 were prepared using a converter process. Immediately after Al deoxidation, the steels were subjected to secondary refining in order of LF and degassing, and Ca was added. Finally, the steels were continuously cast to produce steel pipe materials. Here, high-purity raw material alloys containing no impurity including Ca were used for Al deoxidation, LF, and degassing, with some exceptions. After degassing, molten steel samples were taken, and analyzed for Ca in the molten steel. The analysis results are presented in Tables 4-1 and 4-2. With regard to the Ca adding process, a [% Ca*]/[% T.O] ratio was calculated, where [% T.O] is the analyzed value of oxygen in the molten steel, and [% Ca*] is the amount of Ca added with respect to the weight of molten steel. The results are presented in Tables 4-1 and 4-2.

The steels were cast by round billet continuous casting that produces a round cast piece having a circular cross section. The round billet materials were hot rolled into seamless steel pipes with the billet heating temperatures and the rolling stop temperatures shown in Tables 4-1 and 4-2. The seamless steel pipes were then subjected to heat treatment at the quenching (Q) temperatures and the tempering (T) temperatures shown in Tables 4-1 and 4-2. Some of the seamless steel pipes were directly quenched (DQ), whereas other seamless steel pipes were subjected to heat treatment after being air cooled.

After the final tempering, a sample having a 13 mm×13 mm surface for investigation of inclusions was obtained from the center in the wall thickness of the steel pipe at an arbitrarily chosen circumferential location at an end of the steel pipe. A tensile test specimen and an SSC test specimen were also taken. For the SSC test, three test specimens were taken from each steel pipe sample. These were evaluated as follows.

The sample for investigating inclusions was mirror polished, and observed for inclusions in a 10 mm×10 mm region, using a scanning electron microscope (SEM). The chemical composition of the inclusions was analyzed with a characteristic X-ray analyzer equipped in the SEM, and the contents were calculated in mass %. Inclusions having a major diameter of 5 μm or more and satisfying the composition ratios of formulae (1) and (2), and inclusions having a major diameter of 5 μm or more and satisfying the composition ratios of formulae (3) and (4) were counted. The results are presented in Tables 4-1 and 4-2.

The tensile test specimen was subjected to a JIS 22241 tensile test, and the yield strength was measured. The yield strengths of the steel pipes tested are presented in Tables 4-1 and 4-2. Steel pipes having a yield strength of 758 MPa or more and 861 MPa or less were determined as being acceptable.

The SSC test specimen was subjected to an SSC test according to NACE TM0177, method A. A 24° C. mixed aqueous solution of 0.5 mass % $CH_3COOH$ and $CH_3COONa$ saturated with 0.1 atm (=0.01 MPa) hydrogen sulfide gas was used as a test bath. The test bath was adjusted so that it had a pH of 3.5 after the solution was saturated with hydrogen sulfide gas. The stress applied in the SSC test was 90% of the actual yield strength of the steel pipe. The test was conducted for 1,500 hours. For samples that did not break at the time of 1,500 hours, the test was continued until the pipe broke, or 3,000 hours. The time to failure for the three SSC test specimens of each steel pipe is presented in Tables 4-1 and 4-2. Steels were determined as being acceptable when all of the three test specimens had a time to failure of 1,500 hours or more in the SSC test. The time to failure was listed as "3,000" for steel pipes that did not break in 3,000 hours.

TABLE 3

| | Chemical composition (mass %) | | | | | | | | | | | |
|---|---|---|---|---|---|---|---|---|---|---|---|---|
| Steel No. | C | Si | Mn | P | S | O | Al | Cu | Cr | Mo | B | Ca |
| AA | 0.24 | 0.02 | 0.94 | 0.012 | 0.0012 | 0.0011 | 0.051 | 0.03 | 0.75 | 0.07 | 0.0022 | 0.0012 |
| AB | 0.26 | 0.03 | 1.35 | 0.013 | 0.0009 | 0.0010 | 0.068 | 0.02 | 0.54 | 0.11 | 0.0017 | 0.0016 |
| AC | 0.25 | 0.04 | 1.21 | 0.014 | 0.0011 | 0.0013 | 0.056 | 0.04 | 0.43 | 0.13 | 0.0023 | 0.0014 |
| AD | 0.25 | 0.02 | 1.03 | 0.012 | 0.0013 | 0.0012 | 0.053 | 0.03 | 0.58 | 0.12 | 0.0021 | 0.0013 |
| AE | 0.26 | 0.04 | 1.01 | 0.013 | 0.0012 | 0.0011 | 0.054 | 0.02 | 0.59 | 0.11 | 0.0019 | 0.0012 |
| AF | 0.27 | 0.03 | 0.95 | 0.011 | 0.0009 | 0.0009 | 0.062 | 0.04 | 0.43 | 0.09 | 0.0023 | 0.0015 |
| AG | 0.25 | 0.03 | 1.04 | 0.009 | 0.0013 | 0.0013 | 0.058 | 0.03 | 0.61 | 0.12 | 0.0016 | 0.0013 |
| AH | 0.26 | 0.04 | 1.03 | 0.012 | 0.0011 | 0.0011 | 0.062 | 0.04 | 0.60 | 0.12 | 0.0018 | 0.0014 |
| Al | 0.27 | 0.02 | 0.97 | 0.009 | 0.0013 | 0.0014 | 0.051 | 0.03 | 0.43 | 0.09 | 0.0019 | 0.0011 |
| AJ | 0.26 | 0.04 | 0.98 | 0.012 | 0.0011 | 0.0010 | 0.058 | 0.03 | 0.44 | 0.08 | 0.0018 | 0.0013 |
| AK | 0.26 | 0.03 | 0.96 | 0.014 | 0.0009 | 0.0012 | 0.055 | 0.02 | 0.42 | 0.09 | 0.0020 | 0.0012 |
| AL | 0.22 | 0.02 | 1.37 | 0.012 | 0.0014 | 0.0013 | 0.053 | 0.04 | 0.80 | 0.14 | 0.0024 | 0.0012 |
| AM | 0.23 | 0.04 | 1.44 | 0.011 | 0.0013 | 0.0012 | 0.061 | 0.03 | 0.69 | 0.13 | 0.0019 | 0.0014 |
| AN | 0.25 | 0.03 | 1.29 | 0.012 | 0.0013 | 0.0014 | 0.073 | 0.04 | 0.55 | 0.11 | 0.0018 | 0.0013 |
| AO | 0.24 | 0.04 | 0.91 | 0.011 | 0.0009 | 0.0012 | 0.052 | 0.04 | 0.78 | 0.12 | 0.0024 | 0.0016 |
| AP | 0.23 | 0.04 | 1.09 | 0.010 | 0.0010 | 0.0010 | 0.057 | 0.03 | 0.77 | 0.09 | 0.0017 | 0.0015 |

| | Chemical composition (mass %) | | | | | | | | |
|---|---|---|---|---|---|---|---|---|---|
| Steel No. | Mg | N | Nb* | V* | W* | Ta* | Ti* | Zr* | Classification |
| AA | 0.0003 | 0.0021 | — | — | — | — | 0.005 | — | Compliant Example |
| AB | 0.0005 | 0.0036 | — | — | — | — | — | 0.024 | Compliant Example |
| AC | 0.0004 | 0.0027 | — | — | — | — | 0.009 | 0.019 | Compliant Example |
| AD | 0.0005 | 0.0032 | 0.028 | — | — | — | 0.011 | — | Compliant Example |
| AE | 0.0004 | 0.0028 | — | — | — | 0.16 | 0.013 | — | Compliant Example |
| AF | 0.0002 | 0.0034 | 0.017 | — | 0.09 | — | 0.008 | — | Compliant Example |
| AG | 0.0003 | 0.0029 | 0.024 | — | — | — | — | 0.019 | Compliant Example |
| AH | 0.0002 | 0.0033 | — | 0.014 | — | — | — | 0.018 | Compliant Example |
| Al | 0.0004 | 0.0038 | 0.016 | — | 0.07 | — | — | 0.022 | Compliant Example |
| AJ | 0.0005 | 0.0033 | 0.016 | 0.012 | 0.08 | 0.11 | — | 0.021 | Compliant Example |
| AK | 0.0003 | 0.0035 | — | 0.015 | — | 0.08 | 0.012 | 0.016 | Compliant Example |
| AL | 0.0004 | 0.0026 | — | — | — | — | — | — | Compliant Example |
| AM | 0.0005 | 0.0038 | — | — | — | — | — | — | Compliant Example |
| AN | 0.0004 | 0.0035 | — | — | — | — | — | — | Compliant Example |
| AO | 0.0004 | 0.0036 | 0.019 | — | — | — | — | — | Compliant Example |
| AP | 0.0005 | 0.0039 | — | — | — | — | 0.042 | — | Compliant Example |

※1: Underline means outside the range of the invention

※2: *represents a selective element

TABLE 4-1

| Steel pipe No. | Steel No. | Conditions for adding Ca in steelmaking: Percentage of Ca in molten steel after RH (mass %) | [% Ca*]/[% T.O] | Billet formation: Directly cast billet or rolled billet | Wall thickness (mm) | Outer diameter (mm) | Steel pipe rolling conditions: Billet heating (° C.) | Rolling stop temp. (° C.) | Post-rolling cooling | Steel pipe heat treatment conditions Q1 temp. (° C.) |
|---|---|---|---|---|---|---|---|---|---|---|
| 2-1 | AA | 0.0002 | 0.71 | Directly cast billet | 13.8 | 245 | 1266 | 948 | Air cooling | 891 |
| 2-2 | AB | 0.0006 | 0.87 | Directly cast billet | 13.8 | 245 | 1273 | 942 | Air cooling | 877 |
| 2-3 | AC | 0.0003 | 0.75 | Directly cast billet | 13.8 | 245 | 1269 | 944 | Air cooling | 876 |
| 2-4 | AD | 0.0004 | 0.77 | Directly cast billet | 24.5 | 311 | 1259 | 998 | Air cooling | 882 |
| 2-5 | AE | 0.0002 | 0.68 | Directly cast billet | 24.5 | 311 | 1256 | 997 | Air cooling | 884 |
| 2-6 | AF | 0.0005 | 0.82 | Directly cast billet | 38.1 | 216 | 1213 | 1034 | DQ | 893 |
| 2-7 | AG | 0.0008 | 0.74 | Directly cast billet | 28.9 | 311 | 1241 | 1018 | DQ | 889 |
| 2-8 | AH | 0.0007 | 0.79 | Directly cast billet | 24.5 | 311 | 1258 | 1002 | Air cooling | 877 |
| 2-9 | AI | 0.0004 | 0.66 | Directly cast billet | 24.5 | 311 | 1257 | 999 | Air cooling | 878 |
| 2-10 | AJ | 0.0003 | 0.72 | Directly cast billet | 38.1 | 216 | 1221 | 1028 | DQ | 884 |

| Steel pipe No. | Steel No. | Steel pipe heat treatment conditions: T1 temp. (° C.) | Q2 temp. (° C.) | T2 temp. (° C.) | Number of inclusions of 5 μm or more satisfying formulae (1) and (2) (per 100 mm$^2$) | Number of inclusions of 5 μm or more satisfying formulae (3) and (4) (per 100 mm$^2$) | Yield strength (MPa) | Time to failure in SSC test in 0.01 MPa $H_2S$ saturated pH 3.5 solution (N = 3) (hr) | Remarks |
|---|---|---|---|---|---|---|---|---|---|
| 2-1 | AA | 599 | — | — | 4 | 12 | 800 | 3000<br>3000<br>3000 | Present Example |
| 2-2 | AB | 571 | — | — | 0 | 22 | 771 | 3000<br>3000<br>3000 | Present Example |
| 2-3 | AC | 565 | — | — | 2 | 14 | 808 | 3000<br>3000<br>3000 | Present Example |
| 2-4 | AD | 579 | — | — | 3 | 13 | 833 | 3000<br>3000<br>3000 | Present Example |
| 2-5 | AE | 580 | — | — | 8 | 9 | 846 | 3000<br>3000<br>3000 | Present Example |
| 2-6 | AF | 566 | — | — | 0 | 19 | 809 | 3000<br>3000<br>3000 | Present Example |
| 2-7 | AG | 559 | — | — | 1 | 11 | 817 | 3000<br>3000<br>3000 | Present Example |
| 2-8 | AH | 577 | — | — | 0 | 15 | 822 | 3000<br>3000<br>3000 | Present Example |
| 2-9 | AI | 579 | — | — | 6 | 10 | 839 | 3000<br>3000<br>3000 | Present Example |
| 2-10 | AJ | 557 | — | — | 5 | 12 | 841 | 3000<br>3000<br>3000 | Present Example |

※1: Underline means outside the range of the invention

※2: Formula (1): $(CaO)/(Al_2O_3) \leq 0.25$; Formula (2): $1.0 \leq (Al_2O_3)/(MgO) \leq 9.0$; Formula (3): $(CaO)/(Al_2O_3) \geq 2.33$; Formula (4): $(CaO)/(MgO) \geq 1.0$ In the formulae, (CaO), $(Al_2O_3)$, and (MgO) represent the contents of CaO, $Al_2O_3$, and MgO, respectively, in the oxide-base nonmetallic inclusions in the steel, in mass %.

TABLE 4-2

| Steel pipe No. | Steel No. | Conditions for adding Ca in steelmaking: Percentage of Ca in molten steel after RH (mass %) | [% Ca*]/[% T.O] | Billet formation: Directly cast billet or rolled billet | Wall thickness (mm) | Outer diameter (mm) | Steel pipe rolling conditions: Billet heating (° C.) | Rolling stop temp. (° C.) | Post-rolling cooling | Steel pipe heat treatment conditions Q1 temp. (° C.) |
|---|---|---|---|---|---|---|---|---|---|---|
| 2-11 | AK | 0.0006 | 0.73 | Directly cast billet | 28.9 | 311 | 1239 | 1015 | Air cooling | 876 |
| 2-12 | AL | 0.0005 | 0.65 | Directly cast billet | 24.5 | 311 | 1270 | 991 | DQ | 882 |
| 2-13 | AM | 0.0008 | 0.78 | Directly cast billet | 24.5 | 311 | 1271 | 1002 | Air cooling | 953 |
| 2-14 | AN | 0.0004 | 0.67 | Directly cast billet | 24.5 | 311 | 1269 | 993 | DQ | 879 |
| 2-15 | AO | 0.0007 | 0.71 | Directly cast billet | 24.5 | 311 | 1266 | 989 | DQ | 894 |
| 2-16 | AP | 0.0005 | 0.76 | Directly cast billet | 13.8 | 245 | 1271 | 939 | Air cooling | 892 |

| Steel pipe No. | Steel No. | Steel pipe heat treatment conditions: T1 temp. (° C.) | Q2 temp. (° C.) | T2 temp. (° C.) | Number of inclusions of 5 μm or more satisfying formulae (1) and (2) (per 100 mm$^2$) | Number of inclusions of 5 μm or more satisfying formulae (3) and (4) (per 100 mm$^2$) | Yield strength (MPa) | Time to failure in SSC test in 0.01 MPa $H_2S$ saturated pH 3.5 solution (N = 3) (hr) | Remarks |
|---|---|---|---|---|---|---|---|---|---|
| 2-11 | AK | 561 | — | — | 2 | 11 | 824 | 3000<br>3000<br>3000 | Present Example |
| 2-12 | AL | 575 | — | — | 7 | 12 | 759 | 2817<br>3000<br>3000 | Present Example |
| 2-13 | AM | 502 | 880 | 576 | 1 | 20 | 768 | 1994<br>2796<br>3000 | Present Example |
| 2-14 | AN | 577 | — | — | 7 | 17 | 764 | 2217<br>3000<br>3000 | Present Example |
| 2-15 | AO | 554 | — | — | 3 | 27 | 843 | 3000<br>3000<br>3000 | Present Example |
| 2-16 | AP | 603 | — | — | 4 | 24 | 794 | 2540<br>3000<br>3000 | Present Example |

※1: Underline means outside the range of the invention

※2: Formula (1): $(CaO)/(Al_2O_3) \leq 0.25$; Formula (2): $1.0 \leq (Al_2O_3)/(MgO) \leq 9.0$; Formula (3): $(CaO)/(Al_2O_3) \geq 2.33$; Formula (4): $(CaO)/(MgO) \geq 1.0$ In the formulae, (CaO), $(Al_2O_3)$, and (MgO) represent the contents of CaO, $Al_2O_3$, and MgO, respectively, in the oxide-base nonmetallic inclusions in the steel, in mass %.

The yield strength was 758 MPa or more and 861 MPa or less, and the time to failure for all the three test pieces tested in the SSC test was 1,500 hours or more in the present examples (steel pipe No. 2-1 to 2-16) that had the chemical compositions within the range of the present invention, and in which the number of inclusions having a major diameter of 5 μm or more and a composition satisfying the formulae (1) and (2), and the number of inclusions having a major diameter of 5 μm or more and a composition satisfying the formulae (3) and (4) fell within the ranges of the present invention.

The invention claimed is:

1. A low-alloy high-strength seamless steel pipe for oil country tubular goods, the steel pipe having a yield strength of 758 to 861 MPa, and being a steel having a composition that comprises, in mass %, C: 0.20 to 0.50%, Si: 0.01 to 0.35%, Mn: 0.45 to 1.5%, P: 0.020% or less, S: 0.002% or less, O: 0.003% or less, Al: 0.01 to 0.08%, Cu: 0.02 to 0.09%, Cr: 0.35 to 1.1%, Mo: 0.05 to 0.35%, B: 0.0010 to 0.0030%, Ca: 0.0010 to 0.0030%, Mg: 0.001% or less, and N: 0.005% or less, and in which the balance is Fe and incidental impurities, the steel pipe having a microstructure in which a number of oxide-base nonmetallic inclusions including CaO, $Al_2O_3$, and MgO and having a major diameter of 5 μm or more in the steel, and satisfying composition ratios represented by the following formulae (1) and (2) is 20 or less per 100 mm$^2$, and in which a number of oxide-base nonmetallic inclusions including CaO, $Al_2O_3$, and MgO and having a major diameter of 5 μm or more in the steel, and satisfying composition ratios represented by following formulae (3) and (4) is 50 or less per 100 $mm^2$, $$(CaO)/(Al_2O_3) \leq 0.25 \quad (1)$$

$$1.0 \leq (Al_2O_3)/(MgO) \leq 9.0 \quad (2)$$

$$(CaO)/(Al_2O_3) \geq 2.33 \quad (3)$$

$$(CaO)/(MgO) \geq 1.0 \quad (4)$$

wherein (CaO), ($Al_2O_3$), and (MgO) represent the contents of CaO, $Al_2O_3$, and MgO, respectively, in the oxide-base nonmetallic inclusions in the steel, in mass %.

2. The low-alloy high-strength seamless steel pipe for oil country tubular goods according to claim 1, wherein the composition further comprises, in mass %, one or more selected from Nb: 0.005 to 0.035%,
V: 0.005 to 0.02%,
W: 0.01 to 0.2%, and
Ta: 0.01 to 0.3%.

3. The low-alloy high-strength seamless steel pipe for oil country tubular goods according to claim 1, wherein the composition further comprises, in mass %, one or two selected from Ti: 0.003 to 0.10%, and
Zr: 0.003 to 0.10%.

4. The low-alloy high-strength seamless steel pipe for oil country tubular goods according to claim 2, wherein the composition further comprises, in mass %, one or two selected from Ti: 0.003 to 0.10%, and
Zr: 0.003 to 0.10%.

* * * * *